United States Patent [19]

Baumgart

[11] Patent Number: 4,648,667

[45] Date of Patent: Mar. 10, 1987

[54] SECURITY DEVICE FOR ELECTRICAL PLUG

[76] Inventor: Herbert P. Baumgart, c/o Chicago Avenue Foods, 712 Chicago Ave., Maywood, Ill. 60153

[21] Appl. No.: 756,507

[22] Filed: Jul. 19, 1985

[51] Int. Cl.[4] ..... H01R 13/44

[52] U.S. Cl. ..... 339/37; 339/36

[58] Field of Search ..... 339/37, 82, 84, 87

[56] References Cited

U.S. PATENT DOCUMENTS

| | | | |
|---|---|---|---|
| 3,345,600 | 10/1967 | Scherer | 339/37 |
| 4,060,297 | 11/1977 | Marshall et al. | 339/37 |
| 4,488,764 | 12/1984 | Pfenning et al. | 339/37 |

*Primary Examiner*—Gil Weidenfeld

*Assistant Examiner*—Paula A. Austin

*Attorney, Agent, or Firm*—Wood, Dalton, Phillips, Mason & Rowe

[57] ABSTRACT

An apparatus is provided for preventing the unauthorized use of an electrical device such as a power tool or television set. The apparatus has an enclosure having bottom and peripherally extending side walls and an open top portion affording an inner chamber. Spaced pairs of apertures are located at the top portion on opposite sides of the enclosure. An electrical plug and its associated cable are inserted into the chambe with the shackle of the lock then being inserted through the apertures so as to encircle the electrical cable when in the locked position to capture the electrical plug within the enclosure, thereby preventing unauthorized use.

7 Claims, 3 Drawing Figures

SECURITY DEVICE FOR ELECTRICAL PLUG

FIELD OF THE INVENTION

This invention relates generally to a security device for electrically powered apparatus, and more particularly to a device for preventing unauthorized use of such apparatus by rendering the electrical plug inaccessible.

BACKGROUND OF THE INVENTION

For personal and/or safety reasons it is often desirable to prohibit the use of certain electrically operated devices. For example, when parents desire to prevent their children from watching certain television programs, it may be necessary to prevent the television set from being actuated. Similarly, with potentially dangerous power tools, such as a table saw, it is desirable to prevent children or an unauthorized individual from operating such a tool. The simplest way to achieve either of these goals is to unplug the device from its associated electrical outlet, and thereafter preclude the unauthorized user from reinserting the electrical plug into an outlet.

It is therefore desirable to have available a security device to prevent the unauthorized use of electrically powered devices.

Prior art plug locking mechanisms have generally been restricted to use with certain types of plugs, or alternatively have been constructed in a complicated and costly manner. For example, U.S. Pat. Nos. 2,654,073 and 2,844,805 disclose devices which are limited in their usage to plugs having a predetermined number of prongs and/or a set arrangement therebetween. However, as electrical plug styles change according to voltage and/or grounding requirements, or where a plug is designed to be used in foreign countries, such devices cannot be utilized. It is therefore beneficial to have a universal plug securing device which can be used with any type of electrical plug.

U.S. Pat. No. 4,488,764 discloses an electrical plug locking apparatus which will preclude access to an electrical plug, without regard to the type of plug being used. This apparatus, however, requires the use of a multitude of custom-made parts which can result in increased production costs. Where it may be advisable to own several such plug locking mechanisms for use throughout the household, any such higher costs would be a disadvantage.

With the deficiencies noted with regard to the prior art devices, it would be advantageous to provide an apparatus for preventing the unauthorized use of electrical devices that is designed using relatively few parts, thereby being simple and inexpensive to produce, while also being easy to use.

The present invention is directed to overcoming one or more of the problems as set forth above.

SUMMARY OF THE INVENTION

A principal object of the present invention is to provide an apparatus for preventing the unauthorized use of an electrical device, the apparatus including an enclosure having an opening only at one end through which an electrical plug can be inserted. The enclosure has dual apertures located on opposite sides at the open end of the enclosure. Also provided is a removable lock having a shackle, the shackle being sized to pass through the aperture thereby capturing the electrical plug within the enclosure when the shackle is in a locked position.

Another object of the present invention is to provide an apparatus for preventing the unauthorized use of an electrical device, the apparatus including an enclosure having a bottom and peripherally extending side walls affording an inner chamber. The enclosure is open at its top portion so that an electrical plug can be inserted for positioning in the chamber. Means are included defining spaced pairs of apertures on opposite sides of the enclosure. A removable lock is provided with a shackle which may be selectively movable between a locked and an unlocked position. The shackle is of a size to pass through each of said pairs of apertures and to encircle an electrical conduit attached to the electrical plug when in the locked position to capture the electrical plug within the enclosure.

A further object of the present invention is to provide an apparatus for preventing the unauthorized use of an electrical device wherein the enclosure used to capture the electrical plug has retaining means mounted thereon for permanently and slidably attaching the enclosure to the electrical conduit.

DESCRIPTION OF THE PREFERRED EMBODIMENT

Figure 1:
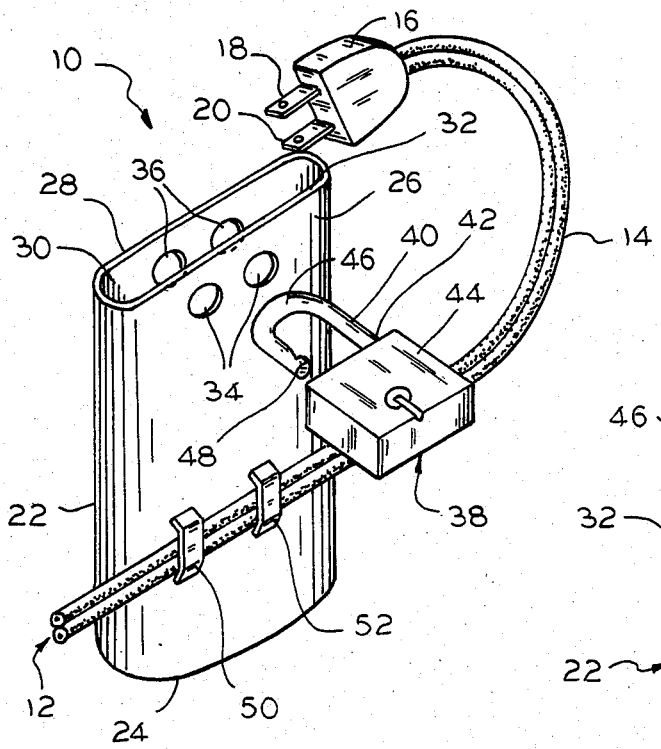
FIG. 1 is a perspective view of the apparatus of the present invention with the shackle of the lock in unlocked position.

Referring to FIG. 1, there is shown the preferred embodiment of the present invention. The present invention is used generally to prevent the unauthorized use of an electrically powered device such as a television set, hair dryer, or saw. Although no such electrically powered device is shown, the device would typically have an electrical conduit or cable 12 attached thereto to enable the electrically powered device to be attached to a source of power.

The cable 12 at its remote end 14 is secured by any known means to an electrical plug 16. The electrical plug 16 as shown has two prongs 18 and 20 to be inserted into an outlet, not shown, for powering the device. While a two prong plug 16 and a two conductor cable 12 are shown, this invention could also be utilized in conjunction with any other known plug and cable arrangement.

An enclosure 22 is provided having a closed bottom portion 24 and peripherally extending side walls 26 and 28 forming an inner chamber 30. The enclosure is open at its top portion 32 so that the electrical plug 16 and remote end of the cable 14 can be inserted for positioning in the chamber 30.

The enclosure while shown being rounded at its edges may also be provided with squared off corners according to the particular material being used for the enclosure. In the preferred embodiment the enclosure is manufactured using any one of a number of prior art flexible materials such as durable plastic, fabric or even metal mesh. However, various other forms of material may be used in constructing the enclosure 22.

At the top portion 32 of the enclosure 22 spaced pairs of apertures 34 and 36 are located on opposite sides of the enclosure 22. Each pair 34 and 36 is provided with equal spacing between the individual apertures in its respective pair 34 and 36. Similarly, each pair 34 and 36 is located directly opposite such that each aperture in one pair 34 or 36 lines up with an associated aperture of the alternate pair 34 or 36.

A lock 38 is provided with a shackle 40. The shackle is selectively movable between a locked and unlocked position. One end 42 of the shackle 40 is rotatably and slidably attached internally to the lock box 44. The shackle also has a U-shaped portion 46 and a notched end portion 48. In the unlocked position as shown in FIG. 1, the end portion 48 of the shackle is removed from the lock box 44 such that the inner end 42 may pivot where it enters the lock box 44.

To apply the plug locking mechanism, the plug 16 and attached portion of cable 14 are inserted in the inner chamber 30 of the enclosure 22 with the cable 14 centrally located between the two pairs of apertures 34 and 36. The shackle 40 of the lock 38 is then inserted through one of the apertures in the pair 34 or 36 through the associated aperture of the opposite pair 34 or 36 and then inserted back through the two remaining apertures. The shackle 40 will then be pivoted to line up the notched end 48 and the lock will be slidably moved to its locked position with the notched end 48 then being internal to the lock box 44.

Figure 2:
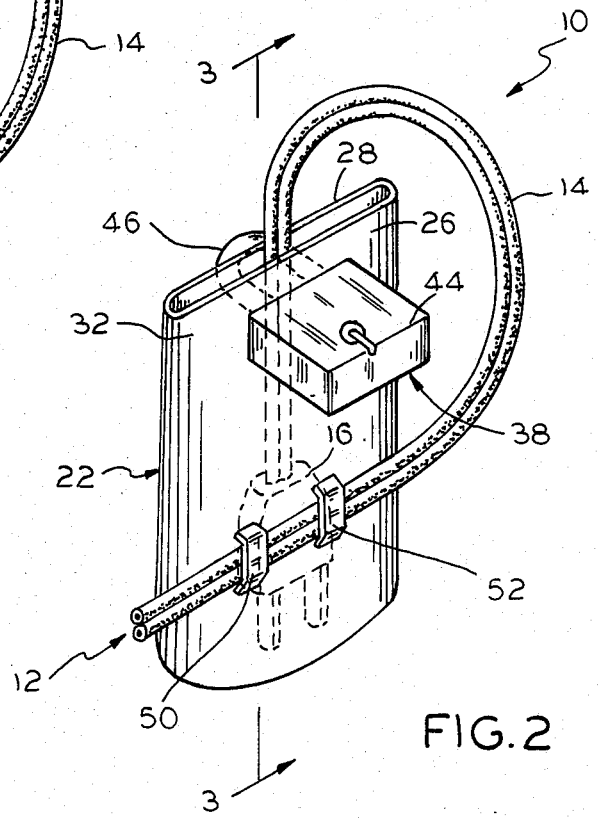
FIG. 2 is a perspective view of the present invention with the shackle of the lock in locked position encircling the electrical conduit and capturing the electrical plug within the enclosure.

Referring now to FIG. 2 there is shown the preferred embodiment of the present invention in which the plug 16 and cable 14 have been placed in the locked position in the inner chamber 30 of the enclosure 22. As can be seen by centrally locating the cable 14 between the pairs of apertures 34 and 36 and then inserting the shackle 40 through said apertures 34 and 36 the cable 14 is encircled by the combination of the side walls 26 and 28 and the shackle 40. In so doing the electrical plug 16 will be captured within the enclosure 22 and cannot be removed without disengaging the lock 38. Therefore, access to the plug is limited to one having the ability to disengage or unlock the lock 38 so that the plug 16 can be removed, thereby preventing unauthorized use of the associated electrical device.

The lock shown is a key actuated lock, however, the invention would work equally well with a combination type lock or any other known lock having a shackle or chain wherein the shackle or chain is of such a size so that it can pass through the apertures 34 and 36.

The security device of the present invention is adapted for sale through consumer channels of trade so that consumers may individually use the devices on electrically powered apparatus which the consumer has previously purchased. The device is also structured and adapted for use by original equipment manufacturers as a permanent attachment and part of their manufactured electrically powered devices.

Figure 3:
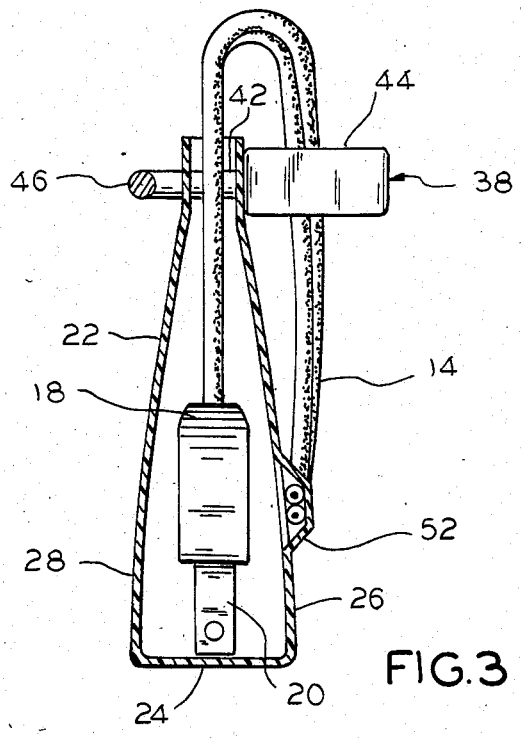
FIG. 3 is a cross sectional view taken as indicated along lines 3—3 of FIG. 2.

The enclosure 22 in an original equipment manufacturer application is preferably provided with two retaining members 50 and 52 to secure the enclosure 22 to the remote end of the cable 14. As shown more particularly in FIG. 3, the retaining members 50, 52 are basically a pair of slits in one of the side walls 26 of the enclosure 22, the slits being of a size to snugly and slidably receive the conduit or cable 14. The cable 14 is inserted through each of the retaining members 50 and 52 prior to being secured to the plug 16 or the electrically powered device. In so doing the enclosure 22 is retained permanently on the cable 14 so that it is readily available for usage immediately after discontinuing use of the power device.

In the preferred embodiment of the present invention, the enclosure would normally be sized in its top portion so that, when in the locked position, the plug 16 could not be removed. Importantly also, the spacing between the apertures 34 and 36 and the size of the shackle 40 should be such that when in the locked position the plug cannot be removed.

In an alternate embodiment, the enclosure 22 may be provided with dual apertures each being located on opposite sides of the top portion of the enclosure. In this embodiment in the locked position the cable 14 would be encircled on three sides by the enclosure and the fourth side by the shackle of the lock to capture plugs 16 within the enclosure. In this instance different types of locks could be used which would not necessarily be U-shaped in nature.

As has been illustrated above, the present invention provides an apparatus design using basically two parts, an enclosure 22, and a lock 38, to provide a reliable and inexpensive device for preventing the unauthorized use of electrically powered devices.

The foregoing description is given for clearness of understanding only and no unnecessary limitations should be implied therefrom, as modifications will be obvious to those skilled in the art.

I claim:

1. An apparatus for preventing the unauthorized use of an electrical device, the electrical device including an electrical conduit attached at one end to the electrical device, and at its other end to an electrical plug, the apparatus comprising:

an enclosure having a bottom and a peripherally extending side wall affording an inner chamber, the enclosure having an open top portion through which the electrical plug can be inserted for positioning in the chamber;

aperture means on opposite sides of the top portion of the enclosure;

a removable lock provided with a locking mechanism and a shackle, the shackle being selectively movable with respect to the locking mechanism between locked and unlocked positions, the shackle being of a size to pass through said aperture means to restrict the size of said open top portion and to capture the entire electrical plug within the enclosure when the shackle is moved to locked positions; and conduit securing means provided on the enclosure for retaining the electrical conduit and the enclosure in assembled relation.

2. The apparatus of claim 1 wherein the conduit securing means includes an opening in the enclosure of a size to snugly and slidably receive the electrical conduit.

3. An apparatus for preventing the unauthorized use of an electrical device, the electrical device including an electrical conduit attached at one end to the electrical device, and at its other end to an electrical plug, the apparatus comprising:

an enclosure having a bottom and a peripherally extending side wall affording an inner chamber, the enclosure having an open top portion through which the electrical plug can be inserted for positioning in the chamber;

aperture means on opposite sides of the enclosure; and a removable lock provided with a shackle selectively movable between a locked and unlocked position, the shackle being of a size to pass through the aperture means and to encircle the electrical conduit so as to capture the electrical plug within the enclosure when the shackle is moved to locked position.

4. The apparatus of claim 3 in which the aperture means includes spaced pairs of apertures, said apertures being positioned to receive the shackle in locked position.

5. The apparatus of claim 3 in which the enclosure is formed of a flexible plastic material.

6. An apparatus for preventing the unauthorized use of an electrical device, the electrical device including an electrical conduit attached at one end to the electrical device, and at its other end to an electrical plug, the apparatus comprising:

an enclosure having a bottom and a peripherally extending side wall affording an inner chamber, the enclosure having an open top portion through which the electrical plug can be inserted for positioning in the chamber;

aperture means on opposite sides of the top portion of the enclosure;

a removable lock provided with a shackle selectively movable between a locked and unlocked position, the shackle being of a size to pass through the aperture means and to encircle the electrical conduit so as to capture the electrical plug within the enclosure when the shackle is moved to locked position; and conduit securing means provided on the enclosure for retaining the electrical conduit and the enclosure in assembled relation.

7. The apparatus of claim 6 wherein the conduit securing means includes an opening in the enclosure of a size to snugly and slidably receive the electrical conduit.

* * * * *